US007533835B2

(12) United States Patent
Hanson

(10) Patent No.: US 7,533,835 B2
(45) Date of Patent: May 19, 2009

(54) FOOD WASTE DISPOSER WITH FOREIGN OBJECT DETECTOR

(75) Inventor: Steven P. Hanson, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 77 days.

(21) Appl. No.: 11/702,476

(22) Filed: Feb. 5, 2007

(65) Prior Publication Data

US 2007/0181718 A1 Aug. 9, 2007

Related U.S. Application Data

(60) Provisional application No. 60/766,706, filed on Feb. 7, 2006.

(51) Int. Cl.
*B02C 4/32* (2006.01)
*B02C 23/36* (2006.01)

(52) U.S. Cl. ..... 241/33; 241/46.013

(58) Field of Classification Search ..... 241/33–37, 241/46.01–46.016
See application file for complete search history.

(56) References Cited

U.S. PATENT DOCUMENTS 3,081,042 A * 3/1963 Moskovitz ..... 241/36
3,420,455 A 1/1969 Chorney
4,128,210 A * 12/1978 Brenner et al. ..... 241/46.014
7,066,415 B2 6/2006 Strutz

OTHER PUBLICATIONS

Invention Disclosure document signed by inventor William F. Strutz on Oct. 31, 1989.

* cited by examiner

*Primary Examiner*—Faye Francis
(74) *Attorney, Agent, or Firm*—Harness, Dickey & Pierce, P.L.C.

(57) ABSTRACT

A food waste disposer system includes a grinding mechanism. The grinding mechanism includes a stationary grind ring and a rotatable shredder plate assembly. A detector is connected to the grinding mechanism to detect the presence of a foreign electrically conductive object in the grinding mechanism. In an aspect, the detector detects that a foreign electrically conductive object is in the grinding mechanism upon sensing that an electrical circuit has been completed between the stationary grind ring and the rotatable shredder plate.

18 Claims, 4 Drawing Sheets

FOOD WASTE DISPOSER WITH FOREIGN OBJECT DETECTOR

CROSS-REFERENCE TO RELATED APPLICATIONS

This application claims the benefit of U.S. Provisional Application No. 60/766,706 filed on Feb. 7, 2006. The disclosure of the above application is incorporated herein by reference.

FIELD

The present disclosure relates generally to food waste disposers.

BACKGROUND

The statements in this section merely provide background information related to the present disclosure and may not constitute prior art.

Food waste disposers are used to comminute food scraps into particles small enough to safely pass through household drain plumbing. A conventional disposer includes a grinding mechanism that is driven by a motor. The grinding mechanism is situated in a housing that forms an inlet connected to a sink drain opening for receiving food waste and water. The grinding mechanism typically includes a rotating shredder plate with lugs and a stationary grind ring attached to the inside of the housing. The motor turns the rotating shredder plate and the lugs force the food waste against the grind ring where it is broken down into small pieces. Once the particles are small enough to pass out of the grinding mechanism, they are flushed out into the household plumbing.

One type of food waste disposer is a "continuous feed" disposer, which is typically actuated by a wall switch. A baffle is situated over the disposer inlet, and food waste can be continuously fed to the disposer through the baffle. The baffle helps keep unwanted items, such as silverware, from inadvertently falling into the disposer. However, a baffle might not prevent all unwanted items from falling into the disposer. If someone is in a hurry when cleaning up after a meal, for example, and scraping waste items from plates and other dishes through the baffle into the disposer, it is possible for other items, such as silverware, to inadvertently be placed into the disposer.

Another type of disposer is a "batch feed" disposer. Batch feed waste disposers operate by filling the disposer with waste, then substantially blocking the drain opening prior to operating the disposer, thereby disposing of food waste in batches. A batch feed disposer uses a stopper device positioned in the drain opening to activate the disposer. The stopper also prevents foreign objects, such as silverware, from entering the disposer during operation, but will typically allow water to flow into the disposer. However, the stopper often is not in place during normal use of the sink, such as for cleaning dishes or cleaning around the sink. When the stopper is not in place, there is nothing to prevent unwanted items such as silverware from falling into the waste disposer.

SUMMARY

A food waste disposer system includes a grinding mechanism having a stationary grind ring and a rotatable shredder plate assembly driven by a motor. A detector is connected to the grinding mechanism to detect the presence of a foreign electrically conductive object, such as metal silverware, in the grinding mechanism.

In an aspect, the motor is deenergized upon the detector detecting the presence of a foreign electrically conductive object in the grinding mechanism.

In an aspect, the detector detects that a foreign electrically conductive object is in the grinding mechanism upon sensing that an electrical circuit has been completed between the stationary grind ring and the rotatable shredder plate by the foreign electrically conductive object. In an aspect, the detector determines that a foreign electrically conductive object is present in the grinding mechanism upon sensing electrical continuity, such as a short, between the stationary grind ring and the rotatable shredder plate assembly.

In an aspect, a low voltage is applied to the stationary grind ring and the rotatable shredder plate assembly is grounded. A detector circuit detects the presence of a foreign electrically conductive object in the grinding mechanism in response to the amount of current flowing between the stationary grind ring and the rotatable shredder plate assembly.

In an aspect, the motor is briefly energized upon the food waste disposer system being turned on, and is then energized to run at full speed if no foreign electrically conductive object is detected in the grinding mechanism and deenergized if the a foreign electrically conductive object is detected in the grind mechanism. In an aspect, the motor is briefly energized only if the detector does not detect the presence of a foreign electrically conductive object in the grinding mechanism upon the food waste disposer system being turned on.

In an aspect, the motor is fully energized upon the food waste disposer system being turned on only if the detector does not detect the presence of a foreign electrically conductive object in the grinding mechanism upon the food waste disposer system being turned on.

In an aspect, the food waste disposer system has an override switch that allows a user to override the detector so that the motor is not deenergized upon the detector detecting the presence of a foreign electrically conductive object in the grinding mechanism.

In an aspect, the detector energizes an indicator upon detecting the presence of a foreign electrically conductive object in the grinding mechanism.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 1 sectional side view showing portions of a food waste disposer embodying aspects of the present disclosure;

Figure 1:
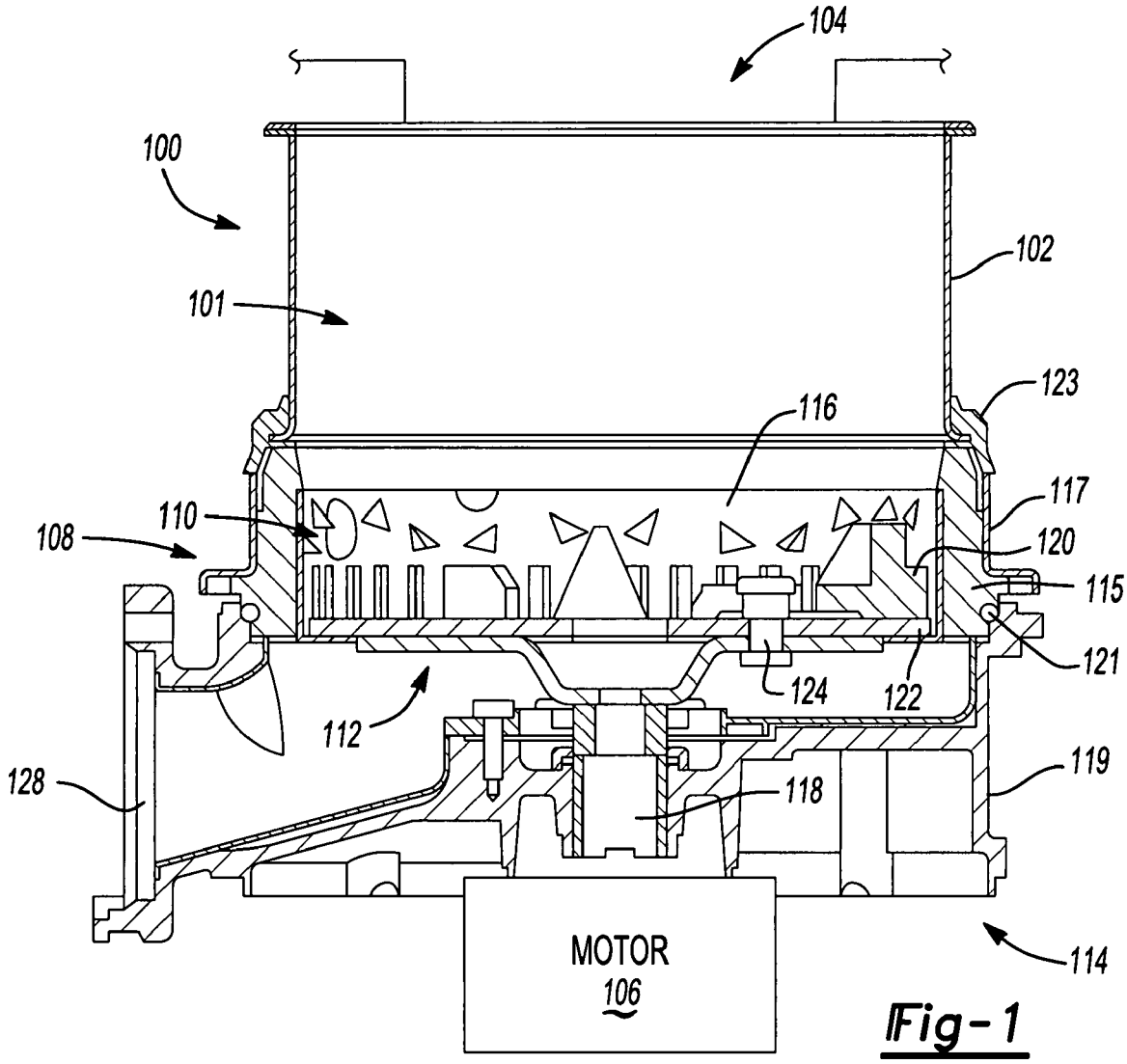

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The following description is merely exemplary in nature and is not intended to limit the present disclosure, application, or uses. It should be understood that throughout the drawings, corresponding reference numerals indicate like or corresponding parts and features.

FIG. 1 illustrates portions of an exemplary food waste disposer 100 in accordance with the teachings of the present disclosure. The food waste disposer 100 includes a food conveying section 101, a grinding section 108 having a grinding mechanism 110, and a motor section 114. Food conveying section 101 has a housing 102 having an inlet 104 that is in communication with a sink drain (not shown) for receiving food waste and water, which is conveyed to the grinding mechanism 110 in grinding section 108. Grinding mechanism 110 includes a rotating shredder plate assembly 112 and a stationary grind ring 116. Stationary grind ring 116 is fixedly situated in an adapter ring 115. Adapter ring 115 may illustratively be made of plastic. Motor section has an upper housing 119 coupled to a lower housing (not shown) in which a motor 106 is disposed. Motor 106 imparts rotational movement to a motor shaft 118, which turns a rotating shredder plate assembly 112 relative to the stationary grind ring 116. A clamp ring 117 of grinding section 108 secures a lower end of housing 102 of food conveying section 101 to adapter ring 115 with a seal member 123 disposed therebetween to seal food conveying section 101 to grinding section 108. An upper end of upper housing 119 of motor section 114 is secured to an adapter ring 115 of grinding section 108 with a seal member 121 disposed therebetween to seal motor section 114 to grinding section 108. It should be understood that the present invention is applicable to food waste disposers having configurations other than the above described configuration having a separate grind section secured to separate food conveying and motor sections. Such configurations may include, by way of example and not of limitation, food waste disposers having a plastic housing with a stationary grind ring press fit therein and a food waste disposer having a metal container body secured to a motor section housing with the stationary grind ring pressed in the metal container body.

The stationary grind ring 116 is made, at least in part, of electrically conductive material, such as metal. The rotating shredder plate assembly 112 is also made, at least in part, of electrically conductive material, such as metal. The shredder plate assembly 112 includes lugs 120 that force the food waste against the stationary grind ring 116 to reduce the waste to small pieces. In the embodiment shown in FIG. 1, the lugs 120 are attached to a plate 122 with a rivet 124 such that the lugs 120 are rotatable relative to the plate 122 (only one lug 120 is shown in FIG. 1). In other embodiments, the lugs 120 may be fixedly attached to the plate 122 such that they do not rotate. When the food waste is reduced to particulate matter sufficiently small, it passes from above the shredder plate assembly 112, and along with water injected into the disposer, is discharged through a discharge outlet 128.

In an aspect, adapter ring 115 is molded of an electrically conductive resin-based material, such as ElectriPlast available from Integral Technologies, Inc. of Bellingham, Wash.

Figure 2:
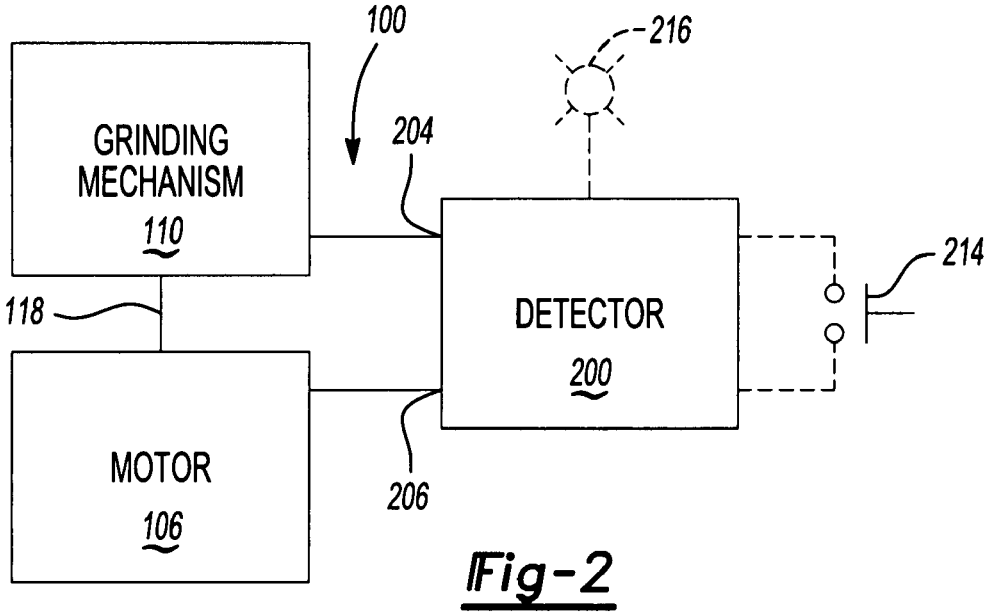
FIG. 2 is a block diagram conceptually illustrating further aspects of the present disclosure.

FIG. 2 is a block diagram illustrating further aspects of the disposer 100. A detector 200 is connected to the grinding mechanism 110 to detect the presence of foreign electrically conductive objects, such as silverware or other metal utensils, in the disposer 100. In an illustrative aspect, detector 200 is a metal detector. In some embodiments, the detector 200 is connected to the motor 106 to control the motor 106 in response to detecting foreign electrically conductive objects in the disposer 100. For example, if the detector 200 detects a foreign electrically conductive object in the grinding mechanism 110, it can immediately turn the disposer off, and/or activate a brake to stop the shaft 118 and rotating shredder plate assembly 112.

In exemplary embodiments, the detector 200 detects the presence of a foreign electrically conductive object in the grinding mechanism 110 by sensing that an electrical circuit has been completed between the rotatable shredder plate assembly 112 and the stationary grind ring 116 by a foreign electrically conductive object. In an aspect, the detector determines that a foreign electrically conductive object is present in the grinding mechanism upon sensing electrical continuity, such as a short, between the stationary grind ring and the rotatable shredder plate assembly. The detector 200 has a terminal 204 coupled to the stationary grind ring 116 (directly or via an electrically conductive component(s) of disposer 100 that is in contact with stationary grind ring 116) and another terminal 206 coupled to the rotating shredder plate assembly 112, typically via the motor shaft bearings. In an aspect, one terminal 204, 206 is coupled to ground, and a voltage is applied to the other terminal 204, 206. Normally, the components of the shredder plate assembly 112, including the lugs 120 and plate 122, do not contact the stationary grind ring 116. If a foreign electrically conductive object, such as a piece of silverware, falls into the grinding mechanism 110, it will likely contact both the rotating shredder plate assembly 112 and the stationary grind ring 116, completing an electrical circuit between the terminals 204, 206 coupled thereto.

Figure 3:
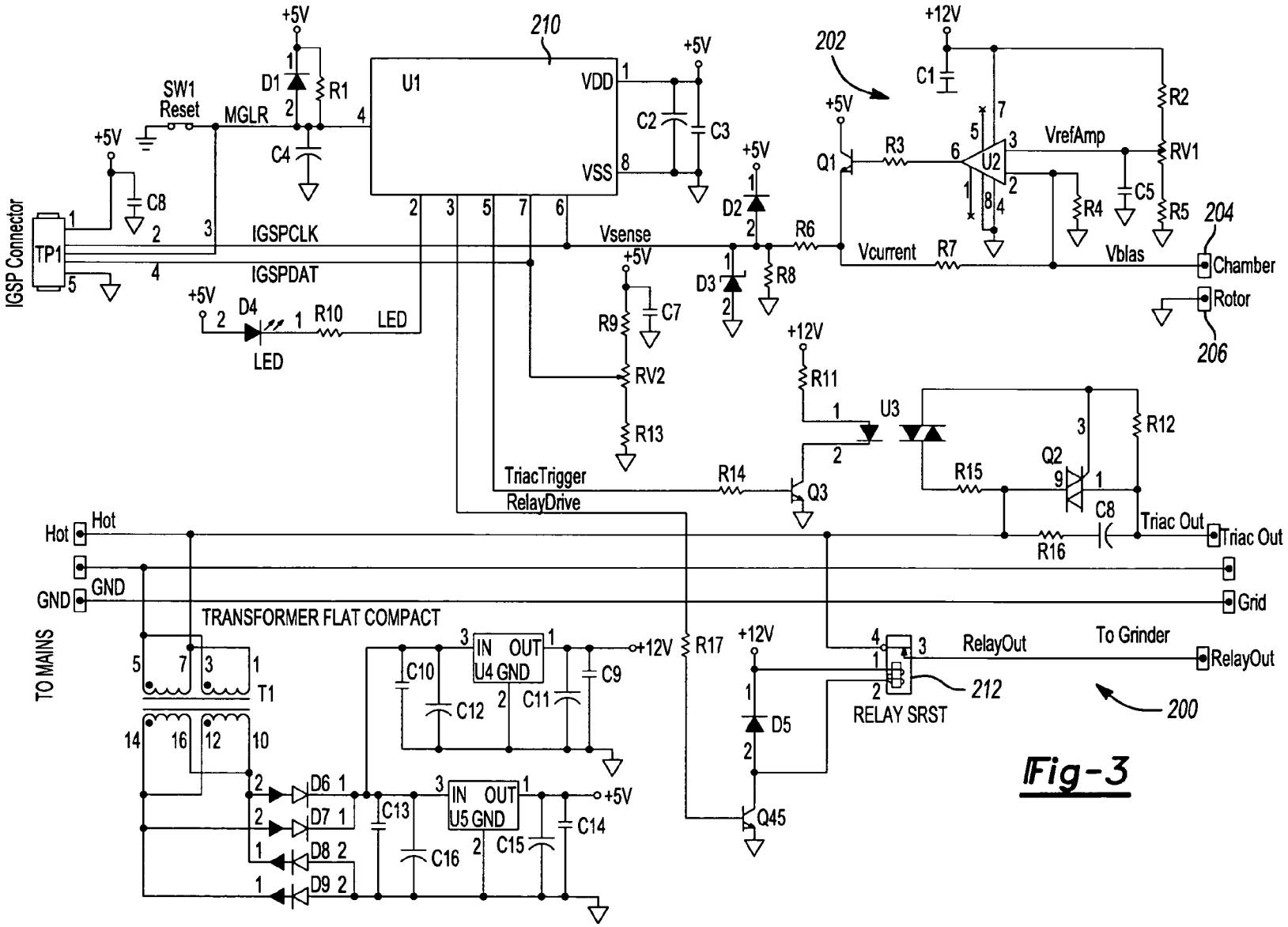
FIG. 3 is a circuit diagram of an embodiment of the metal detector shown in FIG. 2.

FIG. 3 is a circuit diagram showing an exemplary detector 200. The detector 200 functions to detect the presence of a foreign electrically conductive object in the grinding mechanism 110 of the disposer 100. The detector 200 includes a detection circuit 202 that has terminal 204 coupled to the stationary grind ring 116, and terminal 206 coupled to the rotating shredder plate assembly 112 via the bearings of the motor shaft 118. In the illustrated embodiment, detection circuit 202 applies a low voltage to the stationary grind ring terminal 204, and the rotating shredder plate terminal 206 is grounded. In an aspect, the low voltage is about 0.25 volts AC. The detection circuit 202 is responsive to the amount of current that flows between the terminals 204 and 206. With only water and food waste in the disposer, there will be a relatively high resistance between terminals 204 and 206, and only a small current will flow. If a foreign electrically conductive object contacts both the rotating shredder plate assembly 112 and the stationary grind ring 116, there will be a low resistance, such as a short, between the rotating shredder plate assembly 112 and stationary grind ring 116, and a higher amount of current will flow between the terminals 206 and 206. In response to this higher amount of current flow, the detector 200 senses that there is a foreign electrically conductive object in the grinding mechanism 110.

The detection circuit 202 is connected to a controller 210, such as model PIC12F675 microcontroller available from Microchip Technology, Inc., Chandler, Ariz. The controller 210 controls operation of the disposer motor 106 in response to the detection circuit 202 via an output terminal that is connected to a relay 212. When a user activates the disposer, motor 106 will run, thus operating grinding mechanism 110, unless there is a signal from the detector 200 indicating the presence of a foreign electrically conductive object in grinding mechanism 110. If the grinding mechanism 110 is already operating when the foreign electrically conductive object is detected, detector 200 deenergizes motor 106.

If a foreign electrically conductive object falls into the grinding mechanism 110 prior to activation of the disposer 100, it is possible that the object will contact only the stationary grind ring 116 or the shredder plate assembly 112, but not both. Since, in this situation, the foreign electrically conductive object does not complete an electrical circuit between the terminals 204 and 206, the detector 200 will not sense the presence of the foreign electrically conductive object before the disposer is activated and the motor 106 starts. In accordance with the teachings of the present disclosure, the controller 210 will "bump" the motor 106 by turning on the power for a very short time period. This turns the motor shaft 118, and thus the rotating shredder plate assembly 112 a small amount. Usually, this slight movement of the rotating shredder plate assembly 112 will move the foreign electrically conductive object such that it contacts both the stationary grind ring 116 and a component of the rotating shredder plate assembly 112, allowing its presence to be detected. If no foreign electrically conductive object is detected, the motor 106 is switched on full speed. Once the disposer is operating, power will be removed via the relay 212 if a foreign electrically conductive object in grinding mechanism 110 is detected.

In a variation, when food waste disposer 100 is first energized, detector 200 is used to check for the presence of a foreign electrically conductive object in grinding mechanism 110 before motor 106 is energized. Motor 106 is then energized only if detector 200 does not detect the presence of a foreign electrically conductive object in grinding mechanism 110. Motor 106 may be fully energized or briefly energized as discussed above.

Figure 4:
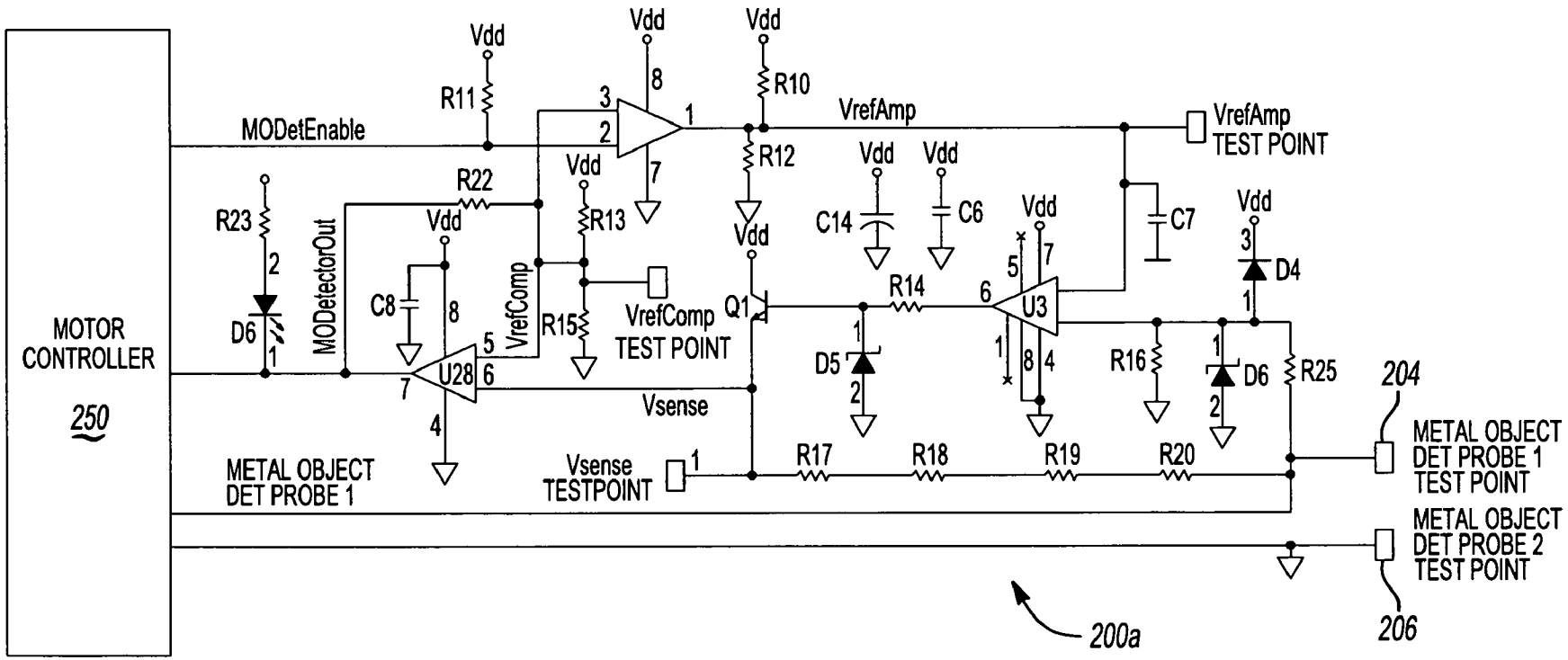
FIG. 4 is a circuit diagram of an alternative embodiment of the metal detector.

FIG. 4 illustrates an alternative detector 200*a*, which does not include the controller 210 as in the embodiment shown in FIG. 3. The detector 200*a* is connected to separate motor controller 250 to signal the motor controller 250 when the presence of a foreign electrically conductive object is detected. As with the detector 200 shown in FIG. 3, terminals 204 and 206 are coupled to the grinding mechanism 110, and the presence of a foreign electrically conductive object is detected in response to relatively higher current flowing between the terminals 204 and 206. It should be understood in a simple embodiment, motor controller 250 may be an on-off circuit, such as a relay, that switches off (e.g., de-energizes the relay that opens the relay's contacts) in response to detector 200*a* detecting the presence of a foreign electrically conductive object.

In other alternative embodiments, a ground fault detector chip is used by the detection circuit. In response to the presence of a foreign electrically conductive object in the grinding mechanism 110, the ground fault detector trips to remove power from the disposer motor 106.

Figure 5:
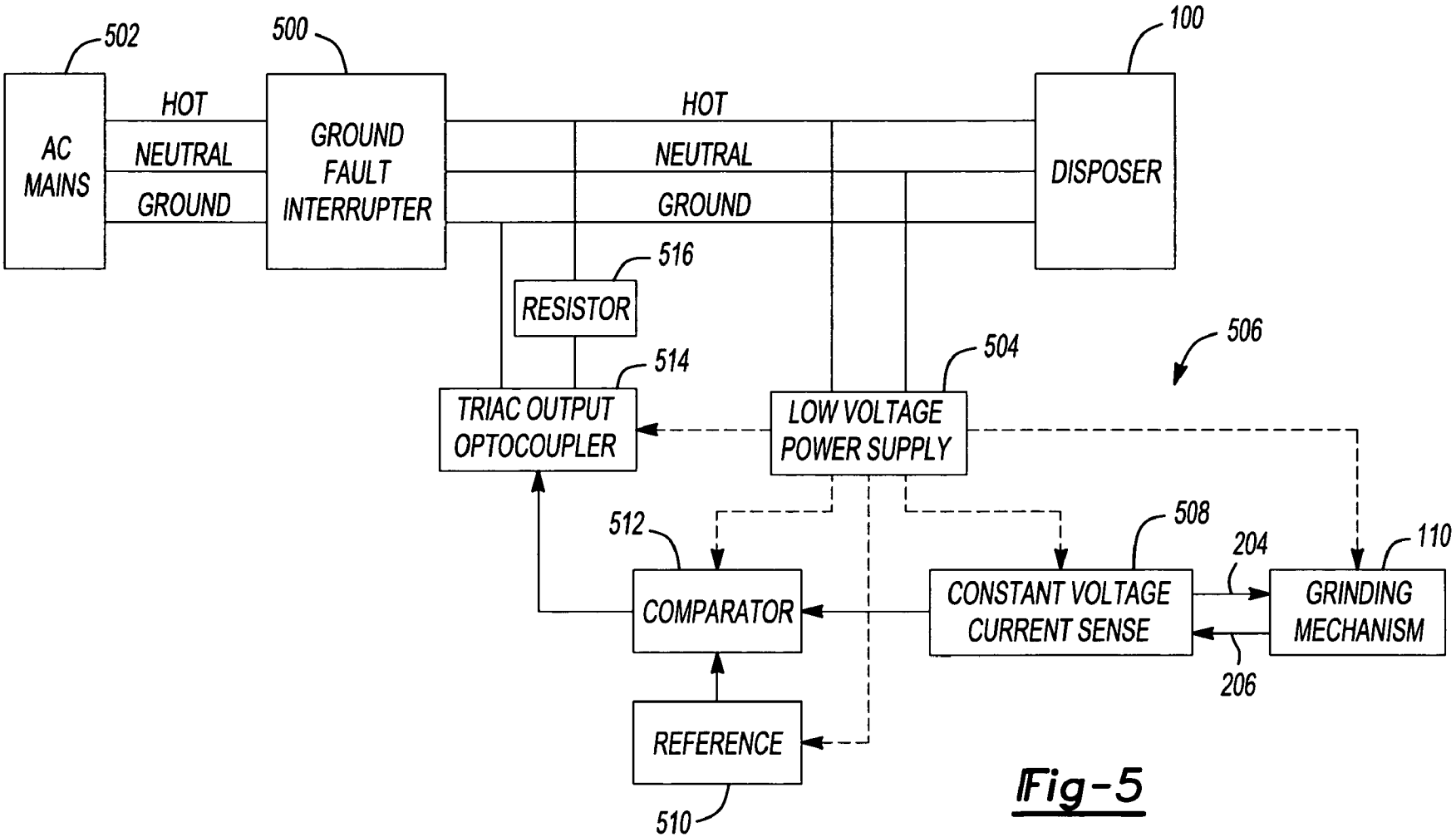
FIG. 5 is a block diagram of an alternative embodiment in accordance with an aspect of the present disclosure utilizing a ground fault interrupter to deenergize the food waste disposer.

FIG. 5 shows an illustrative embodiment in which a ground fault interrupter 500 is used to deenergize the disposer 100 in response to the presence of a foreign electrically conductive object in the grinding mechanism 110. Ground fault interrupter 500 is coupled between AC mains 502 and disposer 100. A low voltage power supply 504 provides power to a detector circuit 506 that includes constant voltage current sense circuit 508, reference 510 and comparator 512. Constant voltage current sense circuit 508 applies a constant voltage across the rotating shredder plate assembly 112 and the stationary grind ring 116 and outputs a voltage to an input of comparator 512 indicative of the amount of current flowing between rotating shredder plate assembly 112 and stationary grind ring 116. The presence of an electrically conductive object in grinding mechanism 110 completes an electrical circuit between rotating shredder plate assembly 112 and stationary grind ring 116, increasing the current flowing between rotating shredder plate assembly 112 and stationary grind ring 116. This causes a change in the voltage that constant voltage current sense circuit 508 outputs to the input of comparator 512. In response to this voltage change, comparator 512 energizes triac output optocoupler 514 which couples the hot line from the AC mains 502 through a resistor 516 to the ground line from AC mains 502. This causes an imbalance in the current flowing through the hot line and neutral line from AC mains 502. Ground fault interrupter 500 responds to this current imbalance by tripping, disconnecting power from disposer 100.

It may be desirable to periodically energize the detection circuit 202, rather than operating it continuously, since a constant, low-level current could cause electrolysis in the grinding mechanism 110. In some embodiments, an override is provided to bypass the detector when desired. For example, some food wastes are more conductive than others. Conductive food waste in the grinding mechanism 110 that does not flush easily with water (such as soy sauce mixed with rice) may cause the detector 200 to remove power from the motor 106 when it is not necessary to do so. The override allows the grinding mechanism 110 to continue operating until the conductive food waste is flushed from the disposer. This override may illustratively be a switch, such as switch 214 shown in phantom in FIG. 2, that is closed by a user to override detector 200.

In an aspect, detector 200 energizes an indicator upon detecting that a foreign electrically conductive object is present in grinding mechanism 110, such as a light 216 shown in phantom in FIG. 2, that alerts a user that a foreign electrically conductive object has been detected in the grinding mechanism 110. It should be understood that the indicator can be any type of device that can alert a user, such as an audible alarm.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A food waste disposer system, comprising:

a grinding mechanism, the grinding mechanism including a stationary grind ring and a rotatable shredder plate assembly;

a motor driving the rotatable shredder plate assembly; and a detector coupled to the grinding mechanism that detects the presence of a foreign electrically conductive object in the grinding mechanism wherein the detector detects the presence of a foreign electrically conductive object in the grinding mechanism upon sensing that the foreign electrically conductive object has completed an electrical circuit between the stationary grind ring and the rotatable shredder plate assembly.

2. The apparatus of claim 1 wherein the detector senses that the foreign electrically conductive object has completed an electrical circuit between the stationary grind ring and the rotatable shredder plate upon sensing electrical continuity between the stationary grind ring and the rotatable shredder plate.

3. The apparatus of claim 2 wherein the detector senses that the foreign electrically conductive object has completed an electrical circuit between the stationary grind ring and the rotatable shredder plate upon sensing a short between the stationary grind ring and the rotatable shredder plate.

4. The apparatus of claim 1 wherein the detector has a first terminal electrically coupled to the stationary grind ring and a second terminal electrically coupled to the rotatable shredder plate assembly and applies a low voltage to either the stationary grind ring through the first terminal or to the rotatable shredder plate assembly through the second terminal.

5. The apparatus of claim 1 including a controller coupled to the detector and the motor, the controller briefly energizing the motor upon the food waste disposer system being turned on and then energizes the motor to run at full speed if the detector does not detect the presence of a foreign electrically conductive object in the grinding mechanism and deenergizes the motor if the detector detects presence of a foreign electrically conductive object in the grind mechanism.

6. The apparatus of claim 5 wherein upon the food waste disposer system being turned on, the controller briefly energizes the motor only if the detector has not detected the presence of a foreign electrically conductive object in the grinding mechanism.

7. The apparatus of claim 1 including a controller coupled to the detector and the motor wherein upon the food waste disposer system being turned on, the controller energizes the motor only if the detector has not detected the presence of a foreign electrically conductive object in the grinding mechanism.

8. A food waste disposer system, comprising:

a grinding mechanism, the grinding mechanism including a stationary grind ring and a rotatable shredder plate assembly;

a motor driving the rotatable shredder plate assembly; and a detector coupled to the grinding mechanism that detects the presence of a foreign electrically conductive object in the grinding mechanism wherein the detector includes a ground fault detector that detects a fault upon a foreign electrically conductive object in the grinding mechanism electrically connecting the stationary grind ring and the rotatable shredder plate assembly and causing the motor to be deenergized.

9. A food waste disposer system, comprising:

a grinding mechanism, the grinding mechanism including a stationary grind ring and a rotatable shredder plate assembly;

a motor driving the rotatable shredder plate assembly;

a detector coupled to the grinding mechanism that detects the presence of a foreign electrically conductive object in the grinding mechanism wherein the detector detects the presence of a foreign electrically conductive object in the grinding mechanism upon sensing that the foreign electrically conductive object has completed an electrical circuit between the stationary grind ring and the rotatable shredder plate assembly; and an override switch that a user can actuate to override the detector and cause the motor not to be deenergized when the detector detects the presence of a foreign electrically conductive object in the grinding mechanism.

10. A method of operating a food waste disposer having a grinding mechanism, the grinding mechanism having a stationary grind ring and a rotatable shredder plate assembly driven by a motor of the food waste disposer, the method comprising:

sensing whether an electrical circuit has been completed between the stationary grind ring and the rotatable shredder plate; and detecting that a foreign electrically conductive object is in the grinding mechanism upon sensing that there an electrical circuit has been completed between the stationary grind ring and the rotatable shredder plate assembly.

11. The method of claim 10 including deenergizing the motor upon detecting that a foreign electrically conductive object is present in the grinding mechanism.

12. The method of claim 10 including sensing that an electrical circuit has been completed between the stationary grind ring and the rotatable shredder plate assemble upon sensing that there is electrical continuity between the stationary grind ring and the rotatable shredder plate assembly.

13. The method of claim 12 including sensing that an electrical circuit has been completed between the stationary grind ring and the rotatable shredder plate assemble upon sensing that there is a short between the stationary grind ring and the rotatable shredder plate assembly.

14. The method of claim 10 including energizing the motor for a brief period of time upon the food waste disposer being turned on, detecting whether a foreign electrically conductive object is in the grinding mechanism after energizing the motor and then energizing the motor to run at full speed if the presence of a foreign electrically conductive object is not detected in the grinding mechanism or then deenergizing the motor if the presence of a foreign electrically conductive object is detected in the grinding mechanism.

15. The method of claim 14 including detecting whether a foreign electrically conductive objecting is in the grinding mechanism upon the food waste disposer being turned on and briefly energizing the motor only if no foreign electrically conductive object is detected in the grinding mechanism upon the food waste disposer being turned on.

16. The method of claim 11 including detecting whether a foreign electrically conductive objecting is in the grinding mechanism upon the food waste disposer being turned on and then energizing the motor only if no foreign electrically conductive object is detected in the grinding mechanism upon the food waste disposer being turned on.

17. The method of claim 11 including upon actuation of a user actuable switch overriding the deenergization of the motor so that the motor is not deenergized upon the detection that a foreign electrically conductive object is in the grinding mechanism.

18. The method of claim 10 including energizing an indicator upon detecting the presence of a foreign electrically conductive object in the grinding mechanism.

* * * * *

UNITED STATES PATENT AND TRADEMARK OFFICE

CERTIFICATE OF CORRECTION

PATENT NO. : 7,533,835 B2
APPLICATION NO. : 11/702476
DATED : May 19, 2009
INVENTOR(S) : Steven P. Hanson It is certified that error appears in the above-identified patent and that said Letters Patent is hereby corrected as shown below:

Column 2,
Line 22, after "if", delete "the".
Line 52, after "FIG. 1", insert --is a--.

Column 5,
Lines 1-2, "terminals 206 and 206" should be --terminals 204 and 206--.

Column 8,
Line 20, Claim 10, after "that", delete "there".
Line 28, Claim 12, "assemble" should be --assembly--.
Line 33, Claim 13, "assemble" should be --assembly--.
Line 46, Claim 15, "objecting" should be --object--.
Line 52, Claim 16, "objecting" should be --object--.

Signed and Sealed this

Third Day of November, 2009

David J. Kappos

David J. Kappos
*Director of the United States Patent and Trademark Office*